United States Patent [19]

Eronini et al.

[11] 4,038,996

[45] Aug. 2, 1977

[54] HAIR BRAIDER

[76] Inventors: Iheanyichukwu E. Eronini, 708 Washington Ave., Albany, Calif. 94706; Abia Sunday Abia, No. 4 Admiral Drive, Emeryville, Calif. 94608

[21] Appl. No.: 637,380

[22] Filed: Dec. 3, 1975

[51] Int. Cl.[2] ..... A45D 1/00

[52] U.S. Cl. ..... 132/9

[58] Field of Search ..... 132/9, 7, 5; 46/242

[56] References Cited

U.S. PATENT DOCUMENTS

| | | | |
|---|---|---|---|
| 2,618,889 | 11/1952 | Wigal | 46/242 |
| 3,536,079 | 10/1970 | Dlouhy | 132/7 |
| 3,603,320 | 9/1971 | Scipione | 132/7 |

*Primary Examiner*—G.E. McNeill

*Attorney, Agent, or Firm*—William R. Piper

[57] ABSTRACT

A portable hair braider which makes use of a plurality of sets of hair parters that are arranged in a row which extends transversely to the path of movement of the device over the top of the head. These hair parters will divide the hair over a predetermined width of the scalp into three separate portions, extending across this width, and then feed these three portions of hair into hair grippers which will clamp and rotate these strands for weaving them together to form a braid. In this manner the hair covering a predetermined width of the scalp is divided into three parts and formed into a single braided strand. The grippers will release the braided hair and immediately repeat the process as the device is moved over the scalp to form a plurality of braides covering the head.

3 Claims, 4 Drawing Figures

HAIR BRAIDER

SUMMARY OF THE INVENTION

An object of our invention is to provide a hair braider which can be used as a tool for braiding the hair or other like material. Novel means is provided initially separating a predetermined width of hair on the head into three strands and then gripping these strands and weaving them into a braid and then automatically freeing the braided hair and immediately repeating the process as the device is moved over the head. Suction means is also used for aligning the hair as each portion enters the hair grabbing members. This will assure that the three hair portions gripped by the three hair grabbers will be arranged in proper order so that the grabbers can now weave these portions into a single braid before releasing the hair whereupon the process is repeated until the device has been moved over the entire head.

DESCRIPTION OF THE PREFERRED EMBODIMENT

Figure 1:
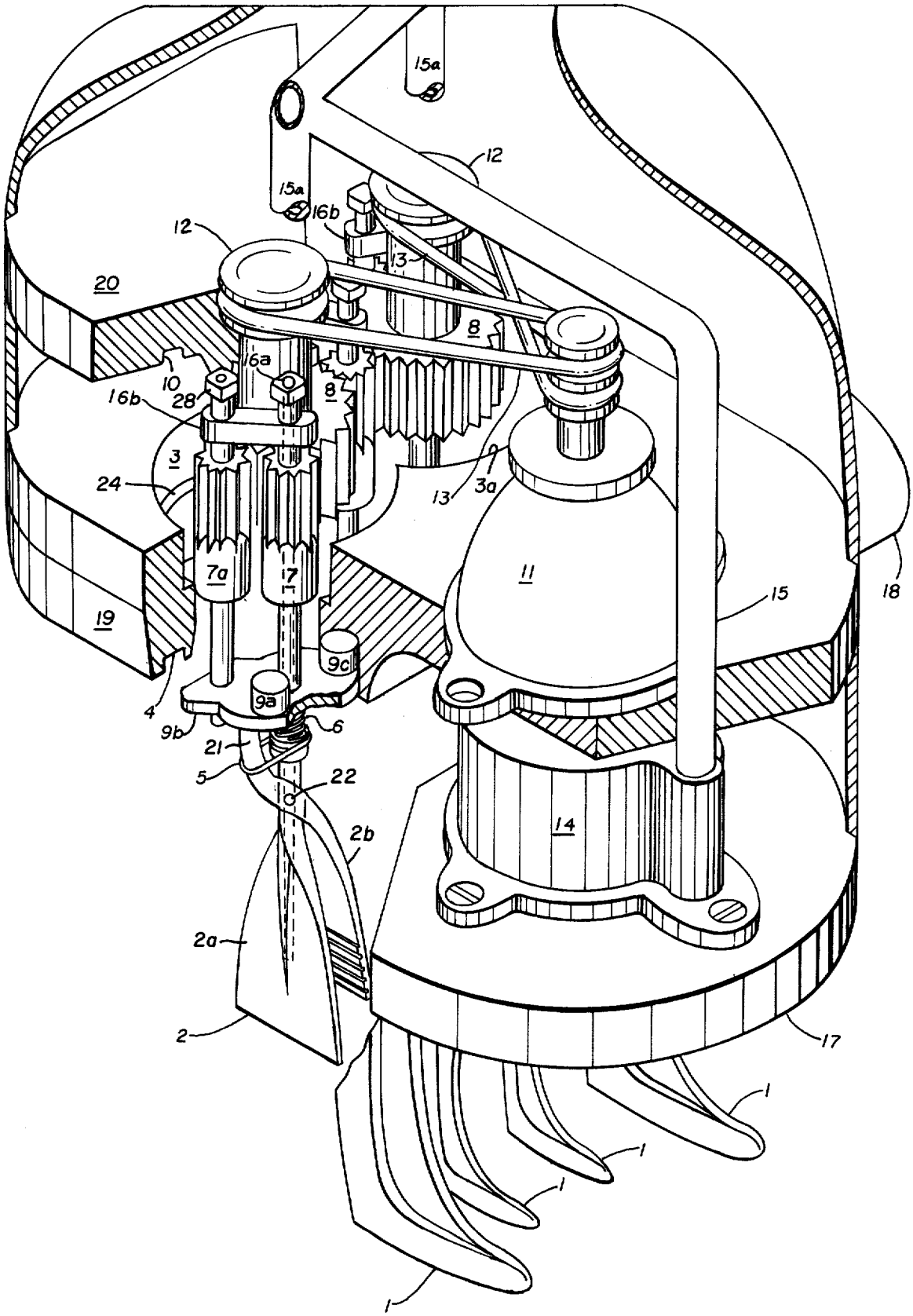
FIG. 1 is a perspective view of the device with parts broken away and shown in section so as to clarify the operating mechanism.

In carrying out our invention we provide a casing which encloses the operating mechanism and includes a bottom plate 17 clearly shown in FIG. 1. An intermediate plate 19 is housed within the casing shell and this intermediate plate parallels the bottom plate and is spaced thereabove. A top plate 20 parallels the intermediate plate and is spaced above it and housed within the casing shell 17 which includes the bottom plate.

Projecting below the bottom plate 17 are a plurality of hair parters 1 and we have shown four of these in FIG. 1 and they are spaced laterally apart from each other, see also the bottom plan view of FIG. 3. The four hair parters are designed to be moved through the hair and adjacent to the scalp as the device is moved over the head and the parters will separate the hair lying between the outermost parters into three separate locks of hair that lie adjacent to each other. In other words the four parters will part the hair at four separated places in forming the intermediate hair into the three portions or strands that are to be woven into a braid.

We provide novel means for aligning the hair in these three hair portions and for feeding these portions into individual hair grabbing members. Each hair grabbing member includes a pair of grabbers and one pair is illustrated in FIG. 1 and is shown at 2. One clamping member of the pair is in the shape of a paddle **2*a* and its shank is in extension of the shaft of a pinion 7 by means of which the member 2*a*** will be rotated about a vertical axis in a manner hereinafter described.

The other hair clamping member **2*b* is also paddle-shaped and its shank 21 is pivoted to the shank of the member 2*a* at 22, see FIG. 1. The upper end of the shank 21 is yieldingly held in sliding contact with a horizontally disposed and vertically movable disc 9*b*, a portion of which is shown in FIG. 1 while the full disc is illustrated in FIG. 3. The disc 9*b* has a pair of openings, one for slidably receiving the shank of the paddle 2*a* which is also the lower end of the shaft for the gear 7. The other opening in the disc 9*b* slidably receives the shaft of a companion pinion 7*a* and the two pinions 7 and 7*a*** cooperate with each other in a manner to be later described.

A coil compression spring 6 is mounted on the shank for the paddle **2*a* and has its upper end yieldingly bearing against the undersurface of the disc 9*b* and has its lower end bearing against a collar rigidly mounted on the shank for the paddle 2*a*. The coil spring 6 tends to move the disc 9*b* vertically on the two shafts for the pinions 7 and 7*a*. The timing of the vertical movement of the disc 9*b* is controlled by a stud 9*a*, see FIG. 1, that projects from the top of the disc 9*b* and is slidably received in a cam groove 4 formed in the under surface of the intermediate plate 19. The cam groove is in the shape of a semi-circle, see FIG. 3, and there are two of these cam grooves as will be explained later. The coil spring 6 urges the disc 9*b* and the stud 9*a* in an upward direction in FIG. 1 and will cause the stud to follow the undulating path formed in the bottom of the groove and this path will cause the disc to move vertically in a predetermined manner and to act on the end of the shank 21 for opening and closing the paddle 2*b* with respect to the paddle 2*a*. The rubber band 5 urges the paddle 2*b* into closed position and the spring 6 maintains the stud 9*a* in sliding contact with the cam groove 4 at all times. In this manner the opening and closing of the hair grabber 2** is controlled.

Figure 3:
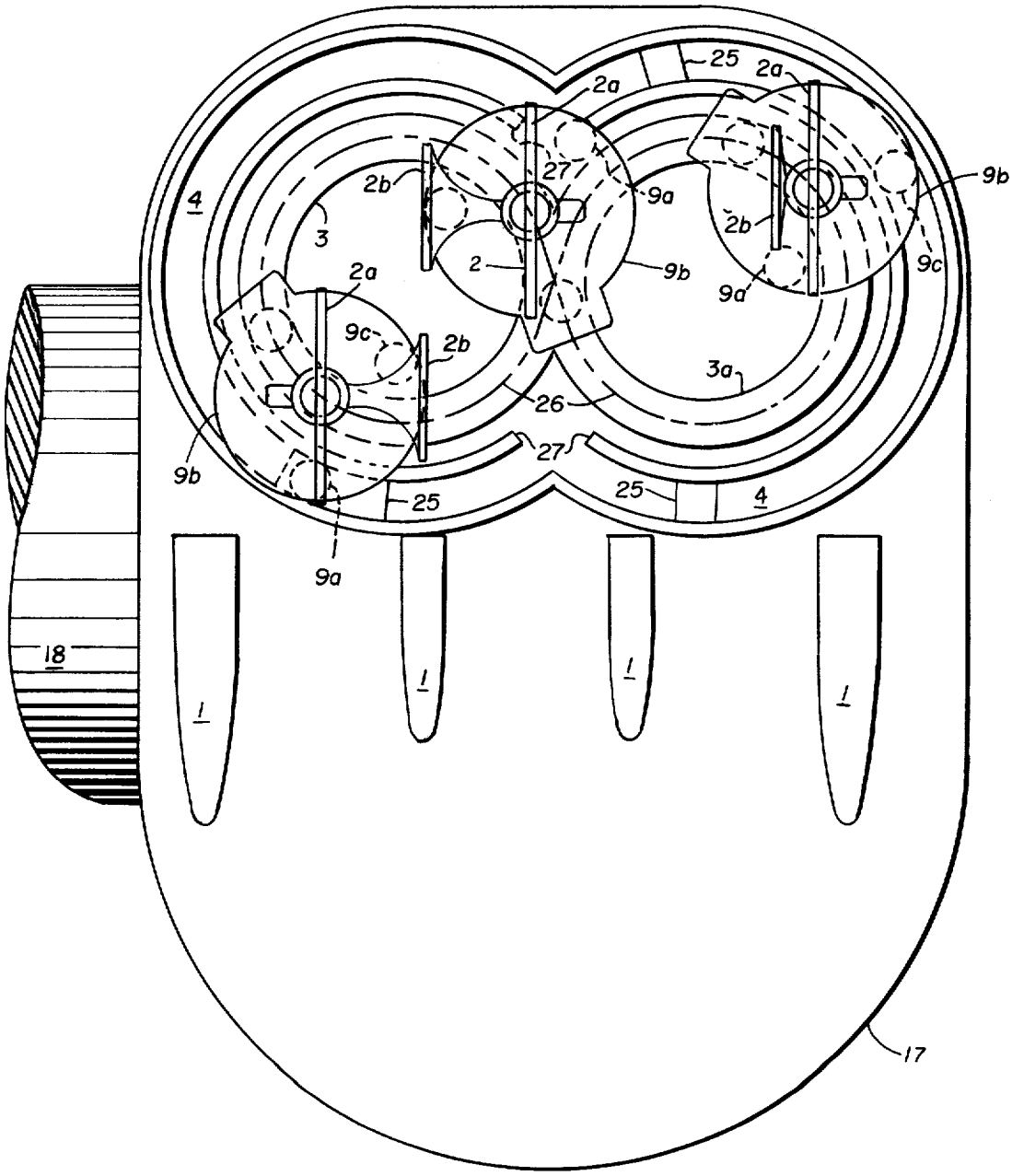
FIG. 3 is a bottom plan view of the device.

There are three hair grabbers 2 and they are shown in bottom plan view in FIG. 3. These three hair grabbers are identical to each other and a detailed description of one will suffice for all three. Each hair grabber is designed to grab a lock of hair that has been separated by two adjacent parters 1, from the remaining hair on the head and to move this lock of hair in the path of a figure eight so as to weave it with the other two locks of hair gripped by the other two hair grabbers 2 to form a braid before releasing the braid. The mechanism for accomplishing this includes the gearing illustrated in FIGS. 1 and 4 and in the semi-circular pathways that intersect to form the figure eight pathway.

Figure 4:
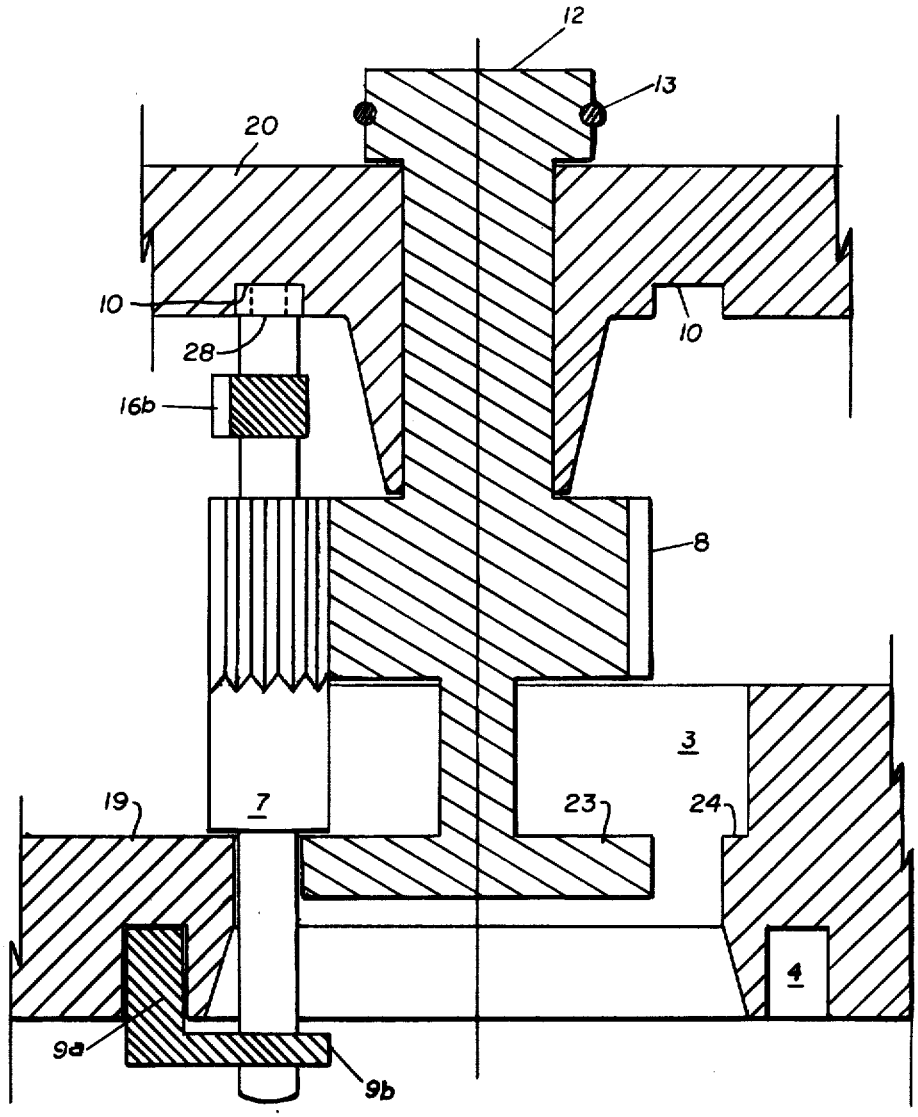
FIG. 4 is an enlarged vertical section through a portion of the device and is taken along the section line A—A of FIG. 2.

We will first set forth the gearing and the source of power for operating it and then will describe the structure that forms the figure eight pathway followed by each of the three hair grabbers 2. We have already mentioned the pair of pinions 7 and **7*a* and these are held in spaced apart parallel relation by a strap 16*b*, see FIG. 1. Both pinions mesh with a drive gear 8. The vertical section of FIG. 4, illustrates the pinion 7 meshing with the gear 8 and further shows the strap 16*b* rotatably receiving the shaft for the pinion 7 which projects above the pinion and has its upper end provided with a rotatable collar 28, see also FIG. 1 that has a square-shaped outer periphery slidably received in a groove 10. It will further be noted in FIG. 4 that the gear 8 has an integral shaft projecting above the gear and rotatably received in a bearing formed in the top plate 20. A pully 12 is keyed to that portion of the gear shaft which extends above the top plate 20. The portion of the gear shaft that extends below the gear 8, carries a disc-shaped end 23 whose periphery rotatably contacts with the lower shaft portion for the pinion 7**. The lower end of the pinion 7 has an annular shoulder that rests on top of the intermediate plate 19 and on the upper surface of the disc 23. What we have described for the gear 8 and its associate mechanism will also hold true for a companion gear 8, shown in FIG. 1 and its associate mechanism.

FIG. 1 illustrates how the two pulleys 12 for the two drive gears 8 are operatively connected to an electric motor 11 by belts 13 that interconnect the pulleys with pulleys mounted on the motor drive shaft. It will be noted from FIG. 2 that the belt 13 for the associate gear 8 (shown on the right hand side of the Figure) is crossed so as to rotate the associate gear in an opposite direction to the left hand gear. In this way the right hand gear 8 will convey the pairs of pinions 7 and 7a in a counterclockwise direction about the axis of the gear and when the pairs of pinions reach the cross over point in the figure eight pattern, they will become meshed with the left hand gear 8 and will be carried around in a clockwise manner around this gear.

We will now describe how the pairs of pinions 7 and 7a are caused to follow the figure eight pattern interconnecting the two drive gears 8 and in addition how the hair grabbers 2 are made to follow a weaving motion which will weave the three strands or locks of hair into a braid before releasing the hair. FIG. 1 illustrates a second stud 9c that projects upwardly from the top of the disc 9b, and FIG. 3 on its left hand portion, shows the stud 9a (9c on the right hand side), being slidably received in the circular cam groove 4 provided in the undersurface of the middle plate 19. At the same time the second stud 9c is travelling in an opening 3 in the intermediate plate 19 whose center coincides with the center of the left hand circular groove 4. There are two openings 3 and 3a in the plate 19 and their cylindrical walls intersect so as to provide a passage between the two as clearly shown in FIG. 1.

Each of the two cylindrical openings 3 and 3a in the middle plate 19 has an inwardly extending circular shoulder 24, see FIG. 1, on which the lower edges of the pinions 7 and 7a slidably ride as the rotating gear 8, meshing with the pinions, carries them around the interior of the openings 3 and 3a. There is some relative rotation of the pinions 7 and 7a about their own axes with respect to the gear 8 with which they are in mesh and this will cause the pinion 7 to rotate its shaft and also the paddle 2a of the hair grabber 2 to which the paddle is attached. There is a raised portion 25 in the bottom of the cam groove 4 that is positioned between the first two parters 1, on the left hand side of the bottom plate 17 when looking at the bottom plan view in FIG. 3. This raised portion 25 will act on the stud 9a on the disc 9b and cause the disc to move away from the bottom of the middle plate 19, see FIG. 1, and slide downardly on the shaft extending below the pinion 7. This movement of the disc is transmitted to the end of the shank 21 of the paddle 2b and causes the paddle 2b to swing away from its associate paddle 2a and receive the strand of hair passing between the two parters 1 positioned on the left hand portion of the bottom plate 17. The raised portion 25 in the bottom of the circular cam groove 4 will only momentarily open the hair grabber paddles 2a and 2b and when they close, as urged by the rubber band 5, they will grip the strand or lock of hair. There are three spaced apart raised portions 25 in the cam groove 4 in the plate 19.

Figure 2:
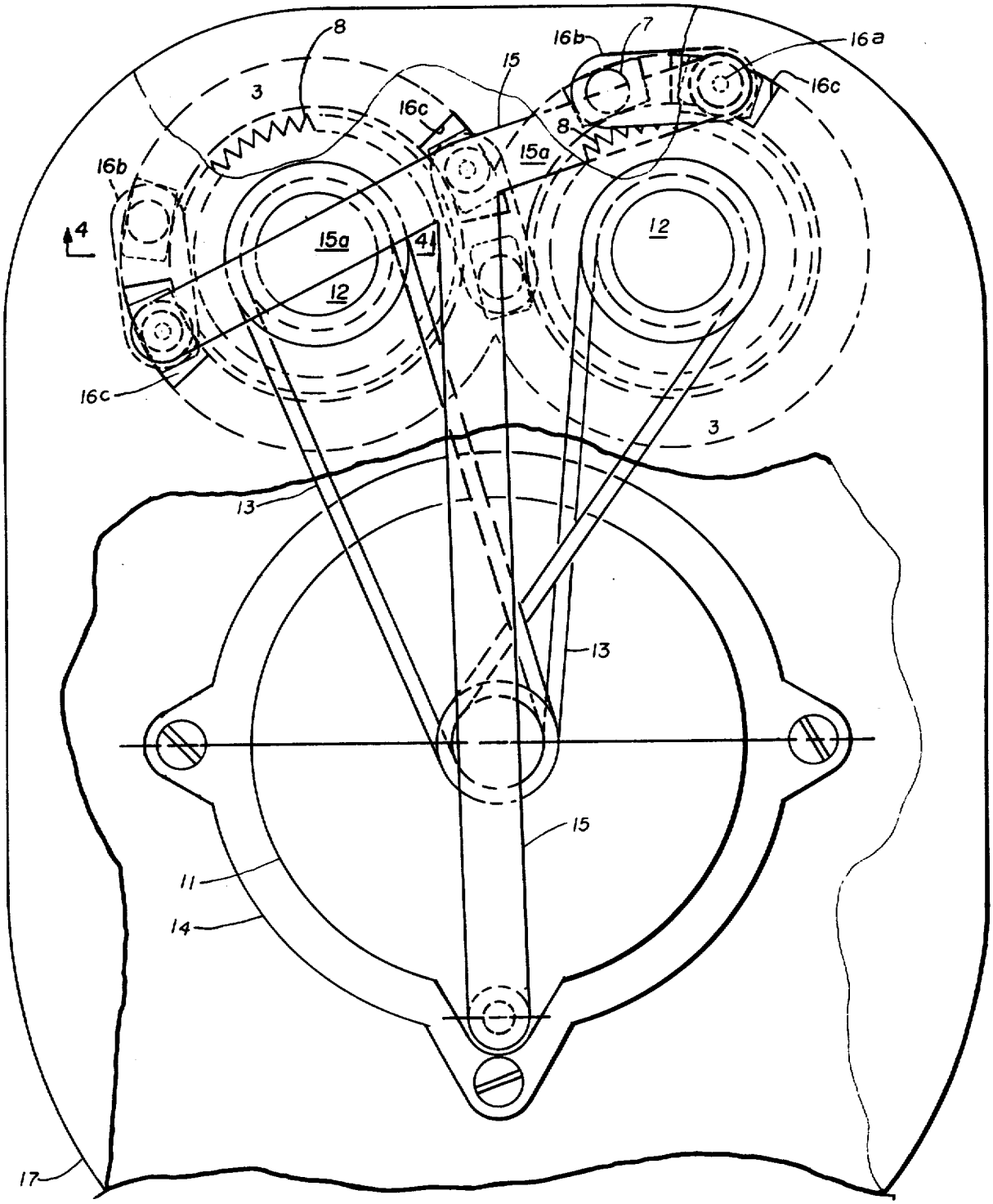
FIG. 2 is a top plan view of the device with portions of the casing being broken away to expose the operating parts. The intermediate plate is not shown.

We provide novel means for causing the strand of hair being grabbed by the paddles 2a and 2b to be drawn upwardly and parallel to the axis of the shaft that has the paddle 2a, see FIG. 1. A suction device 14 driven by the motor 11 draws air through a conduit 15. In FIG. 2 the conduit 15 is shown schematically as communicating with branch conduits 15a, which in turn connect with the suction channels 16c in the plate 20 and these suction channels extend along the axis of the shafts for the pinions 7. There are three branch conduits 15a, each communicating with its associate suction channel 16c. However, in FIG. 2 we illustrate the three straps 16b, each one rotatably holding the upper ends of the shafts for the pinions 7 and 7a in parallel relation, the shafts being slidably received in the circular grooves 10 formed in the undersurface of the top plate 20. The three openings 16c in the top plate 20 communicate with the groove 10 formed in the underside of the plate so that as the suction bore 16a in the shaft for the pinion 7 passes the openings 16c in the plate 20, a sufficient suction will be delivered at the entrance for the bore 16a to cause the hair in the strand disposed adjacent to the paddle 2a, to be drawn into a parallel arrangement with the axis of the suction bore and just prior to the paddle 2b being swung back into hair gripping relation with its associate paddle 2a.

Returning now to the figure eight movement taken by all three discs 9b as they are moved by their pairs of shafts for the pinions 7 and 7a, FIG. 3 shows a bottom view of these three discs and their relation to each other. The left hand disc in this Figure is just passing one of the three high points 25 in the cam groove 4 and the paddles 2a and 2b are shown in open position ready to grasp a lock or strand of hair that has just been separated by the two left hand hair parters 1. The left hand disc 9b is moving in a clockwise direction and the disc stud 9a is riding in the circular cam groove 4 in the middle plate 19. The other disc stud 9c is riding in the cylindrical opening 3 in the middle plate 19.

The middle disc 9b, shown in FIG. 3, has its stud 9a moving out from the end of the semi-circular cam groove 4 in the left hand portion of the figure eight pathway indicated by the dot-dash line 26 and moving into the right hand cylindrical opening 3 in the same Figure. The right hand disc 9b has its stud 9a still travelling in the right hand cylindrical opening 3 and has its stud 9c travelling in a counterclockwise direction in the semi-circular right hand cam groove 4 in the middle plate 19.

There are three spaced apart high points 25 arranged in the two semi-circular portions of the cam groove 4 and there is an open space at the two midian points 27 in the cam groove to permit the disc studs 9a to travel in the left hand semi-circular portion of the groove 4 in a clockwise direction in FIG. 3 and then to cross over and travel in a counterclockwise direction along the interior of the right hand opening 3. At the same time the studs 9c of the discs 9b will travel in the interior of the left hand cylindrical opening 3 in the plate 19 in a clockwise direction and then will cross over at the median space 27 and will travel in a counterclockwise direction in the right hand semi-circular cam groove portion 4. FIG. 3 shows the three spaced apart high points 25 in the cam groove and these are arranged to cause the two paddles 2a and 2b to open up and receive strands of hair which have been divided into three locks by the four hair parters 1 as the device is moved over the head by an operator who grasps the handle 18 shown in FIGS. 1 and 3.

The three hair grabbers will successively grip strands of hair delivered to them by the four hair parters as they move over the head and the figure eight motion of the three discs 9*b* caused by the two gears 8 moving the pairs of meshing pinions 7 and 7*a* from one gear to the other, as shown in FIG. 2, will cause the grabbers to weave the three strands of hair into a braid.

We claim:

1. A hair braider movable over the head of hair and including a body with a bottom plate;

a. a plurality of hair parters carried by and extending below said bottom plate and arranged in a row extending at right angles to the line of movement of said body over the head, said hair parters being spaced apart to form hair receiving areas therebetween;

b. hair grabbers movable past said hair parters and to the rear thereof for individually gripping the portions of hair separated from the rest of the hair on the head; and c. means for moving the hair grabbers in the path of a figure eight and for twisting the grabbers for causing them to twist and to weave the portions of hair thus gripped into a tight braid before releasing the hair.

2. The combination as set forth in claim 1: and in which a. each hair grabber consists of two paddles movable from open to closed position for gripping the hair portions separated by said hair parters; and b. means for creating an air suction between the paddles of each hair grabber just prior to the closing of the paddles;

c. whereby the air suction will draw up the hair portions between the paddles preparatory to the hair portions being gripped.

3. The combination as set forth in claim 1: and in which a. each hair grabber includes a disc and a pair of hair gripping paddles;

b. a plate having a cam groove therein substantially in the shape of a figure eight;

c. said disc having a stud movable along the cam groove;

d. means for moving said discs so as to cause their studs to follow the figure eight path of the cam groove;

e. one pivoted paddle of each pair of paddles being yieldingly held in hair gripping position with respect to its associate paddle, the shank of the pivoted paddle contacting its associate disc; and f. spring means for moving each disc for causing its stud to yieldingly contact the cam groove bottom which has spaced apart high points in the groove for causing the studs to move their discs as they pass the high points for acting on the shank of the pivoted paddle and swinging it temporarily into open position.

* * * * *